US005193334A

United States Patent [19]

Dammann

[11] Patent Number: 5,193,334

[45] Date of Patent: Mar. 16, 1993

[54] YARN FALSE TWIST CRIMPING APPARATUS AND METHOD OF THREADING SAME

[75] Inventor: Peter Dammann, Remscheid, Fed. Rep. of Germany

[73] Assignee: Barmag AG, Remscheid, Fed. Rep. of Germany

[21] Appl. No.: 621,056

[22] Filed: Nov. 30, 1990

[30] Foreign Application Priority Data

Dec. 1, 1989 [DE] Fed. Rep. of Germany ..... 3939726
Jun. 30, 1990 [DE] Fed. Rep. of Germany ..... 4020957

[51] Int. Cl.[5] ..... D01H 13/28; D01H 13/04
[52] U.S. Cl. ..... 57/284; 57/291
[58] Field of Search ..... 57/279, 280, 284, 287, 57/288, 298, 290, 291; 432/59; 28/272, 253, 246, 249

[56] References Cited

U.S. PATENT DOCUMENTS

| | | | |
|---|---|---|---|
| 2,958,921 | 11/1960 | Gilchrist et al. | 57/284 |
| 3,015,872 | 1/1962 | Jones | 432/59 |
| 3,636,697 | 1/1972 | Treptow et al. | 57/280 |
| 3,661,692 | 10/1971 | Kubler et al. | 57/34 |
| 3,701,268 | 10/1972 | Treptow et al. | 68/50 |
| 3,842,578 | 10/1974 | Schippers | 57/280 |
| 3,905,185 | 9/1975 | Bauer et al. | 57/280 |
| 3,930,292 | 1/1976 | Schippers et al. | 28/71.3 |
| 3,971,201 | 7/1976 | Hartig | 57/280 |
| 4,008,560 | 2/1977 | Schnetzer et al. | 57/284 |
| 4,058,961 | 11/1977 | Kubler | 57/34 |
| 4,236,323 | 12/1980 | Dammann et al. | 57/284 X |
| 4,255,134 | 3/1981 | Schippers et al. | 432/59 |
| 4,609,344 | 9/1986 | Runkel et al. | 432/59 |
| 4,641,504 | 2/1987 | Runkel et al. | 432/59 X |
| 4,809,494 | 3/1989 | Dammann | 57/291 |

FOREIGN PATENT DOCUMENTS

| | | | |
|---|---|---|---|
| 1197935 | 7/1970 | Fed. Rep. of Germany . | |
| 3801506 | 8/1988 | Fed. Rep. of Germany . | |
| 1117718 | 12/1954 | France . | |
| 2359913 | 3/1978 | France | 57/280 |
| 1373831 | 1/1972 | United Kingdom . | |

*Primary Examiner*—Daniel P. Stodola
*Assistant Examiner*—John F. Rollins
*Attorney, Agent, or Firm*—Bell, Seltzer, Park & Gibson

[57] ABSTRACT

A yarn false twist crimping apparatus includes a curved heating plate which faces away from the service aisle. A cover is positioned to overlie the upper surface of the heating plate, and the cover is mounted for movement between a closed position covering the heating plate and an open position wherein the heating plate is uncovered. To initially thread-up a yarn, the cover is closed and the yarn is guided to an intermediate position along the outside of the cover. The advance of the yarn is then commenced, and the cover is then momentarily opened so that the yarn drops onto the heating plate.

27 Claims, 4 Drawing Sheets

YARN FALSE TWIST CRIMPING APPARATUS AND METHOD OF THREADING SAME

BACKGROUND OF THE INVENTION

The present invention relates to a false twist crimping apparatus for crimping synthetic filament yarns and a method of threading the yarn thereon.

Machines of the described type are known from DE-OS 38 01 506.4. Also in the known machine, such as is described, for example in DE-OS 38 01 506.4, yarn guides are arranged at a distance from the yarn heating plate, into which the yarn is inserted for the purpose of threading. These yarn guides define an temporary position of the yarn path, in which the yarn is guided without contacting the heating plate.

The known machines are very well suited, when the heating plate faces the service aisle. However, DE-OS 38 01 506.4 also discloses such machines, in which the heating plate faces away from the service aisle, so that it is difficult to thread the yarn.

It is the object of the present invention to provide an apparatus and method for threading the yarn on the heating plate in a service-friendly manner and which permits the yarn to be readily threaded, and which is applicable in particular on machines having heating plates which face away from the service aisle.

SUMMARY OF THE INVENTION

The above and other objects and advantages of the present invention are achieved in the embodiments illustrated herein by the provision of a yarn heating apparatus which comprises an elongate yarn heating plate, cover means mounted for movement between a closed position covering the heating plate and an open position wherein the heating plate is uncovered, and yarn supporting means for supporting the yarn for advance along an temporary path of travel on the side of the cover means opposite the heating plate when the cover means is in the closed position, and for releasing the yarn when the cover means moves to the open position so that the yarn is free to drop onto the heating plate for advance along an operative path of travel in contact with the heating plate.

In accordance with the present invention, the cover means is utilized for guiding the yarn when the latter is threaded. To this end, the yarn guides are arranged on the cover means. In a preferred embodiment, when the cover means is closed, the yarn is guided in the temporary yarn path by both stationary yarn guides, which precede or follow the heating plate and are aligned with the latter, and yarn guides which are attached to the cover means. In this temporary yarn path, it is possible to then insert the yarn in the false twist unit and into the feed system downstream of the false twist unit, which are both in operation, and advance and false twist the yarn.

When the cover means is opened, the yarn is released for threading on the heating plate. Subsequently, the feed system upstream of the heating plate is engaged, thereby starting the operation.

The apparatus and method of the present invention allow the yarn to be threaded on a heating plate which faces away from the service aisle and to put the processing station into operation at the same time.

A special advantage of the invention is that it is not necessary to open the cover means so as to bring the yarn in the temporary yarn path, in which the yarn extends at a distance in front of the hot plate. Rather, the cover means is opened only when the yarn is in its temporary path, i.e., advances substantially parallel to the heating plate. As a result, it is necessary to open the heater only for a very short period of time.

In the preferred embodiment, the cover means is divided into separate longitudinal segments, and with the cover segments being separately moveable between the open and closed positions. This structure is particularly suitable for processing sensitive yarns, such as undrawn or partially oriented yarns (POY), which still need to be finish drawn during the false twist texturing operation. More particularly, this structure permits the yarn to be advanced and false twisted while subjecting it to only a slight heating. To this end, one partial length of the cover means can be opened in such a manner that the yarn drops over this partial length onto the heating plate and contacts the plate at that point. Preferably, the partial length is at the beginning of the plate. Only after this "preheating" the yarn is brought to its operating tension, and the drawing is initiated. Then, the yarn is able to withstand also the heating over the entire length of the heating plate, and the other partial lengths of the cover means are then opened.

To bring the yarn to its temporary path parallel to the heating plate, the yarn guides on the side facing away from the heating plate are open. Various possibilities for unloading the yarn from the yarn guides are available. A preferred and important feature of the present invention is that this unloading occurs synchronously with the opening and preferably by the opening of the cover means In one embodiment, the cover means comprises a pair of laterally adjacent covers, and each cover may be rotated or tilted about an axis parallel to the heating plate, so that the yarn can be dropped, for example, from the yarn guides. To this end, the contact surfaces of the yarn guides are constructed straight or slightly curved. The contact surfaces project beyond the cover edge to such an extent that the dropping yarn falls into the heating plate.

However, in the case of this embodiment, each cover will also have to perform a lateral movement in addition to its rotating or tilting movement, so as to effect an opening. As already indicated, however, it is a preferred object of the present invention to construct each cover and the yarn guides such that the opening movement also represents simultaneously the movement necessary for the dropoff. This objective is achieved in still another embodiment, where the cover means comprises a pair of laterally adjacent covers, with a first guide edge means mounted to one cover and a second guide edge means mounted to the other cover. In the closed position, the two guide edge means define a yarn receiving Vee when viewed in cross section. It is possible to apply this embodiment especially when double heaters are used. In this case, the heating plate contains two parallel grooves, one for each yarn. The two covers are separated along a center plane between these two grooves, and each cover can be opened separately. During the opening by rotating or laterally shifting of one cover, the guide edge means attached thereto serves as a supporting edge, which loses is supporting function, when the cover is opened. The guide edge means located on the other cover is operative as a sliding edge, which remains stationary and along which the yarn slides off. Since the sliding edge terminates substantially above the vertical center plane of the opened heater groove, the yarn drops into this heater groove. In the case of a rotatable cover, the sliding or supporting edges are curved, with the center of curvature preferably being located substantially along the axis of rotation of the cover associated to them.

The above embodiment has the advantage that it is possible for both tiltable and laterally displaceable covers. Laterally displaceable covers have the advantage that they can be adapted to the curvature of the heating plate. In the case of laterally displaceable covers, it is possible to provide for the movement of the yarn onto the heating plate by providing a yarn guide which is carried on each cover, and a fixed yarn contacting member which serves to engage the yarn carried by the yarn guide when the cover is moved to its open position so as to cause the yarn to be released and drop onto the heating plate.

Any of the displaceable embodiments also provides a constant distance between the heating plate and the cover surface facing it over the length of the heating plate, in that the covers may be curved so as to follow the curvature of the heating plate.

To be able to adapt the covers to a considerable curvature of the heating plate, the covers may be divided into separate longitudinal segments. When threading sensitive yarns, for example, of polyester, it will be useful to preheat the yarn somewhat. To this end, the separate opening of the cover segments will be of service, in that the division of the cover into segments ensures that the yarn contacts the heating plate only over a short length, and a damage to the yarn to be threaded by the heat is precluded until its final drawing.

To initially thread the yarn along the yarn guides, it may be helpful to use a piston which is moved over the yarn guides, and to which a yarn carrier is attached, note for example DE-PS 24 55 117. The piston may slide in an air-carrying tube, which possesses an arm to carry along the yarn (note De-PS 2454 668), or an air-carrying, slotted tube, in which the yarn is advanced (note DE-PS 24 29 722 or German Patent Application 39 32 306.4).

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figure 1:
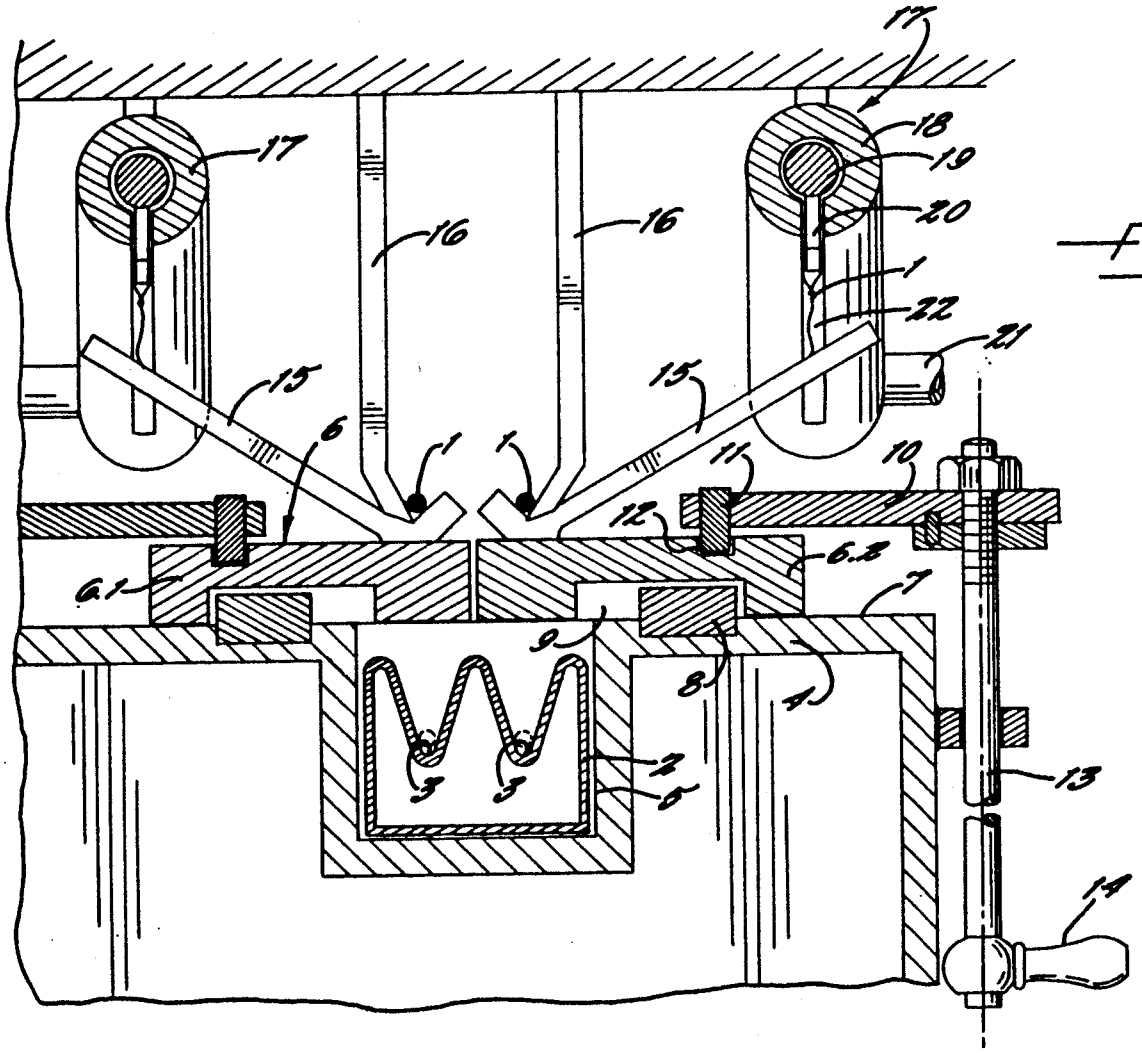
FIG. 1 is a cross sectional view of a yarn heating apparatus which embodies the features of the present invention.

Shown in all embodiments is a yarn heating apparatus which includes a heating plate 2. The heating plate is provided with two yarn grooves 3. It should be noted that the illustrated embodiments are all arranged symmetrically to their longitudinal direction, i.e, to their central plane, which is indicated by the dash-dot lines in FIGS. 1-3. Thus, the mirror plane extends in the center between the two yarn guide grooves 3. The heating plate 2 is of hollow profile, which is filled with a heat-transferring fluid or a heat-transferring vapor and hermetically closed. In the illustrated embodiments, a surface of the heating plate is made wavy, so that two yarn grooves 3 are formed. The heating plate is inserted into a channel 5 of an insulating box 4 with a rectangular cross section. Thus, the insulating box 4 surrounds the heating plate 2 on three sides, and the yarn grooves 3 are directed to the outside of the channel 5. On its outside, the channel 5 is closed by cover means which is generally indicated at 6. The cover means 6 is divided in longitudinal direction along the center plane between the two yarn grooves 3, thus resulting in two separate covers 6.1, 6.2, which can be separately opened.

In the embodiment of FIG. 1, the two covers 6.1 and 6.2 are movable laterally, i.e. in a direction perpendicular to the longitudinal direction of the heating plate 2. To this end, the covers 6.1 and 6.2 extend on the upper side 7 of the insulating box 4. A wedge 8 which is attached to the insulating box 4, and a groove 9 on the underside of the cover, serve for straight-line guidance. For the movement of the covers, a rocking lever 10 is used, which is attached to a pivot rod 13, and which engages with its free end a block 11 sliding in a guideway 12 on the upper side of the cover. The rod 13 can be pivoted with a handle 14.

Mounted on the upper side of each cover 6.1 and 6.2 are several longitudinally spaced apart yarn guides 15. Each yarn guide 15 has a sliding edge inclined toward the mirror plane. The sliding edge terminates in the region of the mirror plane in a slight trough. A plurality of longitudinally spaced apart and fixedly mounted yarn contacting and dropoff guides 16 project into this trough. To this end, each yarn dropoff guide 16 possesses an end, which forms an acute angle with the sliding edge of the yarn guide 15 and it is sufficiently short so that the yarn moving down the sliding edge is able to slide below the end of the yarn dropoff guide 16 and into the trough. The yarn guides 15 and the dropoff yarn guides 16 are staggered relative to each other in the longitudinal direction and spaced apart from each other. The end of the dropoff guides 16 extends below the sliding edge of the yarn guides 15 only a short distance.

Above the sliding edges of the yarn guides 15, threading yarn guides 17 are arranged. A threading yarn guide 17 is shown in FIG. 1 as a tube 18, in which a piston 19 slides. The tube 18 extends over the entire length of the heating plate. The tube 18 has a longitudinal slot 22, and the piston 19 is provided with an arm 20 projecting from the longitudinal slot. The tube can be supplied with compressed air through a connecting pipe 21. A yarn 1 may be attached to the arm 20.

It should be noted that other threading yarn guides 17 may be used, such as, for example, the yarn guide which will be described below with reference to FIG. 2.

To thread a yarn, the piston 19 is moved to the region of the inlet side of the heating plate, and the yarn is attached to the arm 20 by a loop. Then, compressed air is supplied to the tube, so that the piston moves to its other end position. In so doing, the arm 20 carries the yarn 1 along and places it on the inclined sliding edge of the yarn guides 15. As a result of inserting the yarn into the feed systems upstream and downstream of the heater, the yarn 1 is tensioned and slides now along the inclined edge of the yarn guide 15. In so doing, it enters into the wedge-shaped gap, which is formed by the inclined sliding edge of yarn guide 15 and the end of the yarn dropoff guide 16. The yarn is able to move below the end of the dropoff guide 16 and to thus enter into the trough of the yarn guides 15. At this point, the two yarns advance without being in contact with the heating plate 2. By the displacement of the two covers 6.1 and 6.2, it becomes now possible to thread the two yarns 1. To this end, the lever 10 is pivoted. As a result, the two covers perform a movement substantially perpendicular to the mirror plane, whereby the yarns get caught behind the lower ends of the dropoff guides 16, which project in the shape of a hook, and they are pushed over the ends of yarn guide 15 and finally drop down. Since the yarn dropoff guides 16, which are in this process contacted by the yarn, are arranged substantially vertically above the yarn grooves 3, the yarns drop into the gap opening between two covers 6.1 and 6.2 and into the yarn grooves 3. In so doing, the covers can be returned to their closed position. The entire process of opening and threading the yarn takes only a fraction of a second, so that the heat losses are very small.

Figure 2:
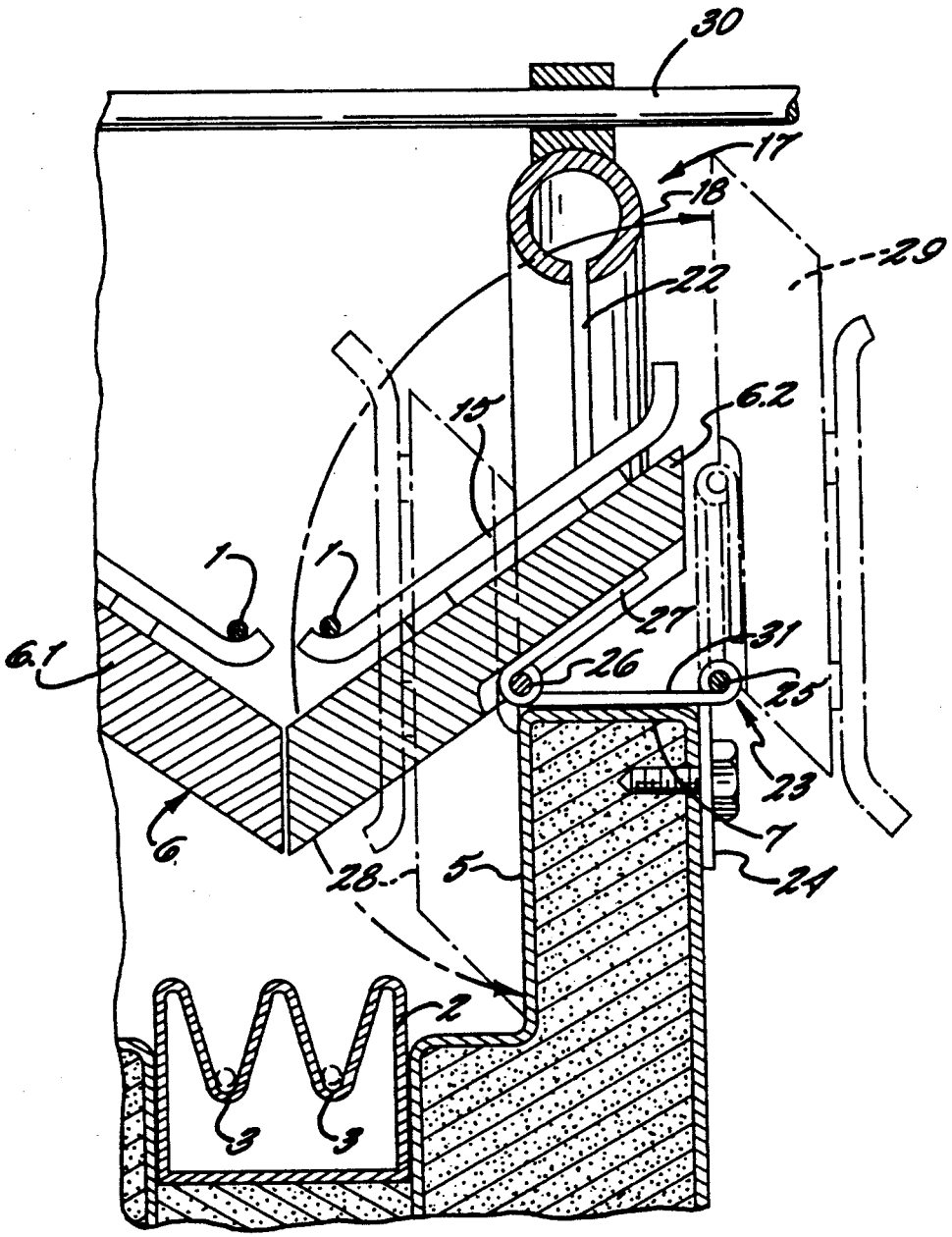
FIGS. 2 and 3 are similar cross sectional views of further embodiments of the present invention.

In the embodiment of FIG. 2, the two covers 6.1 and 6.2 are rotatably supported. To this end, a double hinge lever 23 is used. The double hinge lever 23 is provided with a fixed lever 24, which is attached on an outside wall of the insulating box 4. Connected with the fixed lever 24 is an temporary lever by means of a first joint 25. This temporary lever rests on the upper side 7 of the insulating box 4. The temporary lever is connected by means of a second joint 26 with a cover lever 27 attached to the cover. The two joints 25 and 26 are each located at the corners of the outline of the insulating box 4. On the upper side of the cover facing away from the heating plate 2, a plurality of yarn guides 15 are mounted in the longitudinal direction. These yarn guides have a sliding edge, which terminates in the region of the heating plate in a trough. In its operating position, each cover is locked in position such that the cover with the yarn guides 15 mounted thereon, slopes toward the center plane of the heating plate.

Arranged above the two covers are yarn threading devices 17. In the embodiment of FIG. 2, an air carrying tube 18 is shown, which has a slot 22 extending over its entire length. The tube itself extends over the entire length of the heating plate. It can be moved on a guide rod 30 vertically to the center plane of the heating plate, so that it does not interfere with the pivotal movement of the cover, which will be described below.

The covers 6.1 and 6.2 are in their closed position in FIG. 2. For purposes of threading, the yarn is placed against the tube 18 in the region of the yarn inlet of the heating plate, and advanced by the air current generated in the tube 18 to the opposite end of the tube 18 and the heating plate. In so doing, the yarn drops from the slot 22 onto the yarn guide 15 as a result of the developing yarn tension. The yarn then slides along the edge of the yarn guide 15, which is inclined in the closed position, into the trough. When the two yarns advance in the trough, the cover 6.2 on the right side in FIG. 2 is rotated anticlockwise, whereas the other cover 6.1, which is shown only in part, is rotated clockwise. To enable this rotation, the insulating channel 5 is here shown somewhat deeper than in the embodiment of FIG. 1. Its depth corresponds to about half of the cover width. As a result of this rotation, the yarn guide 15 is also tilted to the unloading position 28 shown in dashed lines. Since the end of the yarn guide 15 is so long that it is located in the tilted position substantially vertically above one of the yarn grooves 3, each yarn is unloaded into its designated groove. Now, the two covers can be closed again, in that they are rotated back to the position shown in solid lines.

Beyond the above, it is also possible to open the covers so completely that the heating plate can be readily cleaned. To this end the yarn threading devices 17 on the guide rod 30 are moved so far that they do not impede the rotation of the cover. Then, each cover can be rotated to the cleaning position indicated in dashed lines at 29.

Figure 3:
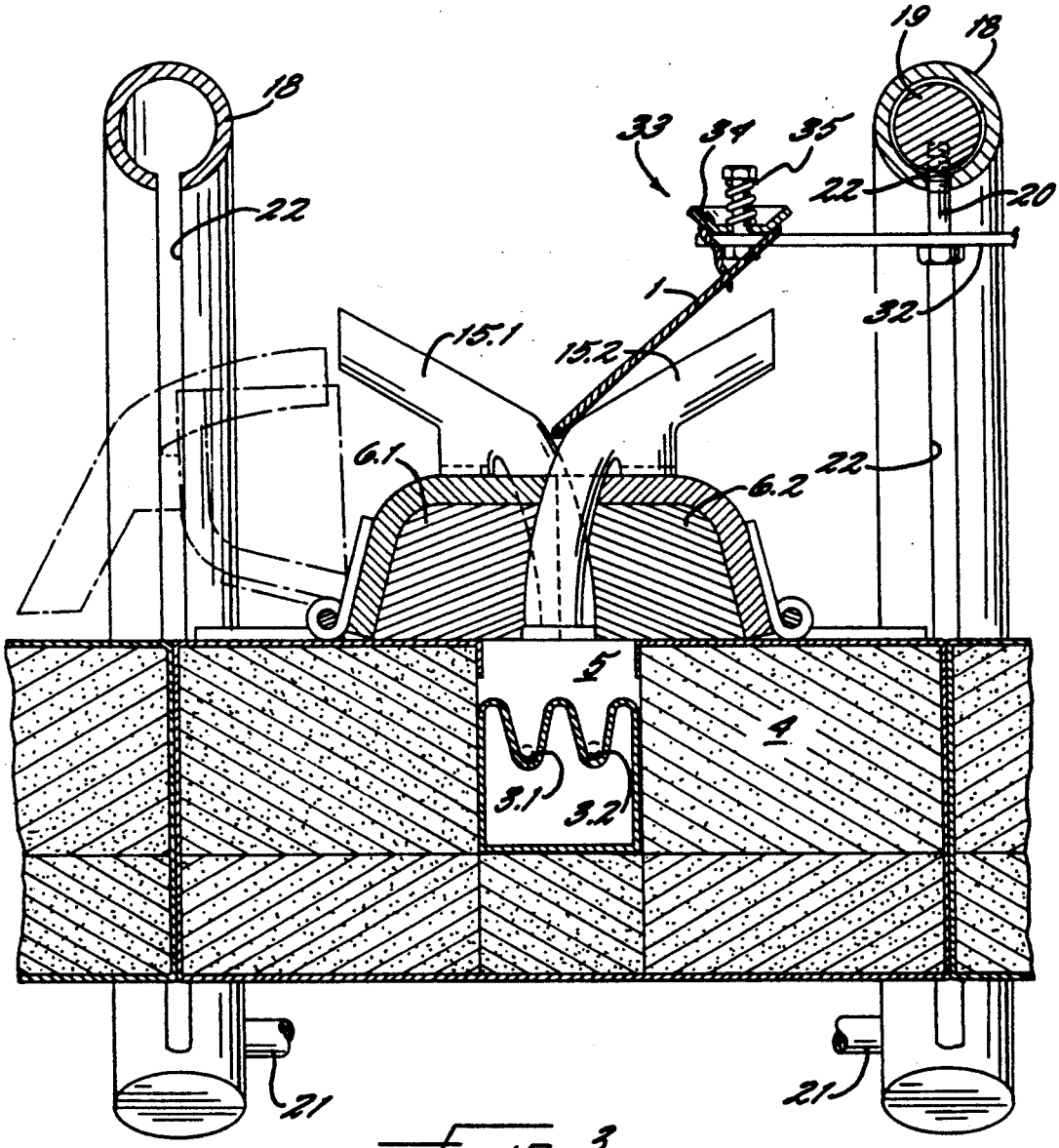

In the embodiment of FIG. 3, the cover means 6 is likewise divided in the center plane between the two yarn grooves 3.1 and 3.2, thus resulting in two covers 6.1 and 6.2. Each of the covers is rotatably supported in one or several hinges. As a result, it is possible to open each of the covers 6.1 or 6.2 independently of the other cover so as to expose the channel 5 above the yarn groove 3.1 or 3.2. Attached to each of the covers 6.1, 6.2 are pairs of strips 15.1 and 15.2 respectively, i.e., of each pair, one strip 15.1 is mounted on the left cover 6.1 and the other strip 15.2 on the right cover 6.2. The two strips cross each other and form, when viewed in cross section, a Vee, whose apex extends in the center plane between the two yarn grooves 3.1 and 3.2, and which is upwardly open, i.e. on its side facing away from the heating plate.

Otherwise, each of the strips 15.1, 15.2 also extends beyond the apex of the Vee, i.e. into the center plane through the bottom of one of the grooves 3.1, 3.2. Thus, the strip 15.1, which is attached to the left cover 6.1 projects beyond the apex of the Vee to the center plane through the right yarn groove 3.2. The other strip 15.2, which is mounted on the right cover 6.2, extends to the center plane through the left yarn groove 3.1. It should be added that each of the edges slopes from its beginning forming the opening of the Vee to its end in direction toward the heating plate. Furthermore, the strips 15.1, 15.2 are curved, with the center of curvature being located approximately on the axis of rotation of each of the hinges associated to the covers 6.1 and 6.2.

Yarn threading devices 17 are arranged above and in the center between respectively two adjacent heating systems. In the embodiment of FIG. 3, an air-carrying tube 18 is shown, which has a slot 22 over its entire length. The tube extends over the entire length of the heating plate. At its two ends, the tube is provided with an inlet pipe 21 for compressed air. A piston 19 slides in the tube. The piston 19 is displaced in the tube by the compressed air supplied at the one or the other end of the tube. Attached to the piston 19 is an arm 20, which projects through the slot 22 to the outside. The free end of the arm 20 accommodates a double arm 32. Mounted on each end of the double arm 32 is a clamping device 33 for the yarn. Illustrated in FIG. 3 is a clamping plate 34, which is pushed with its bottom resiliently against the end of the double arm 32 by means of a spring 35. The yarn can be pulled under the plate bottom by looping the plate edge. The double arm 32 is sufficiently long so that it projects respectively over the opening of the Vee formed by the strips 15.1 and 15.2.

When the yarn is threaded, both covers 6.1 and 6.2 are closed. Two yarns are placed on two adjacent heaters by means of a yarn threading device, in FIG. 3 the yarn threading device on the right. To this end, the yarn advancing from a supply package is looped with its end about the edge of the plate 34 and thereby held in position in the clamping device 33. Then, the piston 19 is displaced by compressed air supplied into the tube 18 from the inlet end of the heater to the outlet end thereof. As a result the yarn held in the clamping device comes to lie in the V-shaped bottom of the crossing pairs of strips 15.1 and 15.2. Furthermore, the yarn is guided over the subsequent cooling plate, inserted into the false twist unit downstream thereof, and withdrawn by a suction gun. It is now possible to insert the yarn into the feed system upstream of the heater, to advance and twist it. Then, the cover 6.2 shown on the right side in FIG. 3 is opened, while the left cover half remains closed. The movement which is performed by the strip 15.2 can be noted from the end position of the strip 15.1 on cover half 6.1, which is shown in dashed lines. For a better view, it was not shown for the right cover half. When the strip 15.2 is now rotated to the right in corresponding manner by opening the cover 6.2, the V-shaped bottom of the crossing strips 15.1, 15.2 migrates on the strip 15.1 which remains stationary, downward in direction of the heating plate. The strip 15.1 is so shaped that its end facing the heating plate is located substantially in the center plane of yarn groove 3.2. Thus, the yarn slides along the strip 15.2, while the other strip 15.1 remaining stationary, and retains its supporting function. As soon as the strip 15.2 is rotated away so far that it no longer crosses the other strip 15.1, the yarn drops downward in direction of the heating plate into the right yarn groove 3.2. The fact that the heater can be opened in segments, the yarn is first brought in contact with only a partial length of the heating plate. Now, the feed system downstream of the false twist unit can be engaged, thereby starting the drawing and false twisting of the yarn. Subsequently, the remaining heater segments are also opened. It is now possible to thread the yarn in the left yarn groove 3.1 and in the adjacent heating system on the left. Before, the piston 19 is returned by an additional supply of compressed air to its initial position in the region of the yarn inlet of heating system. Further, the cover 6.2 is again closed. This results in the advantage that only one half of the channel 5 needs to be opened in each case. As a result it is possible to keep the heat losses low.

Figure 4:
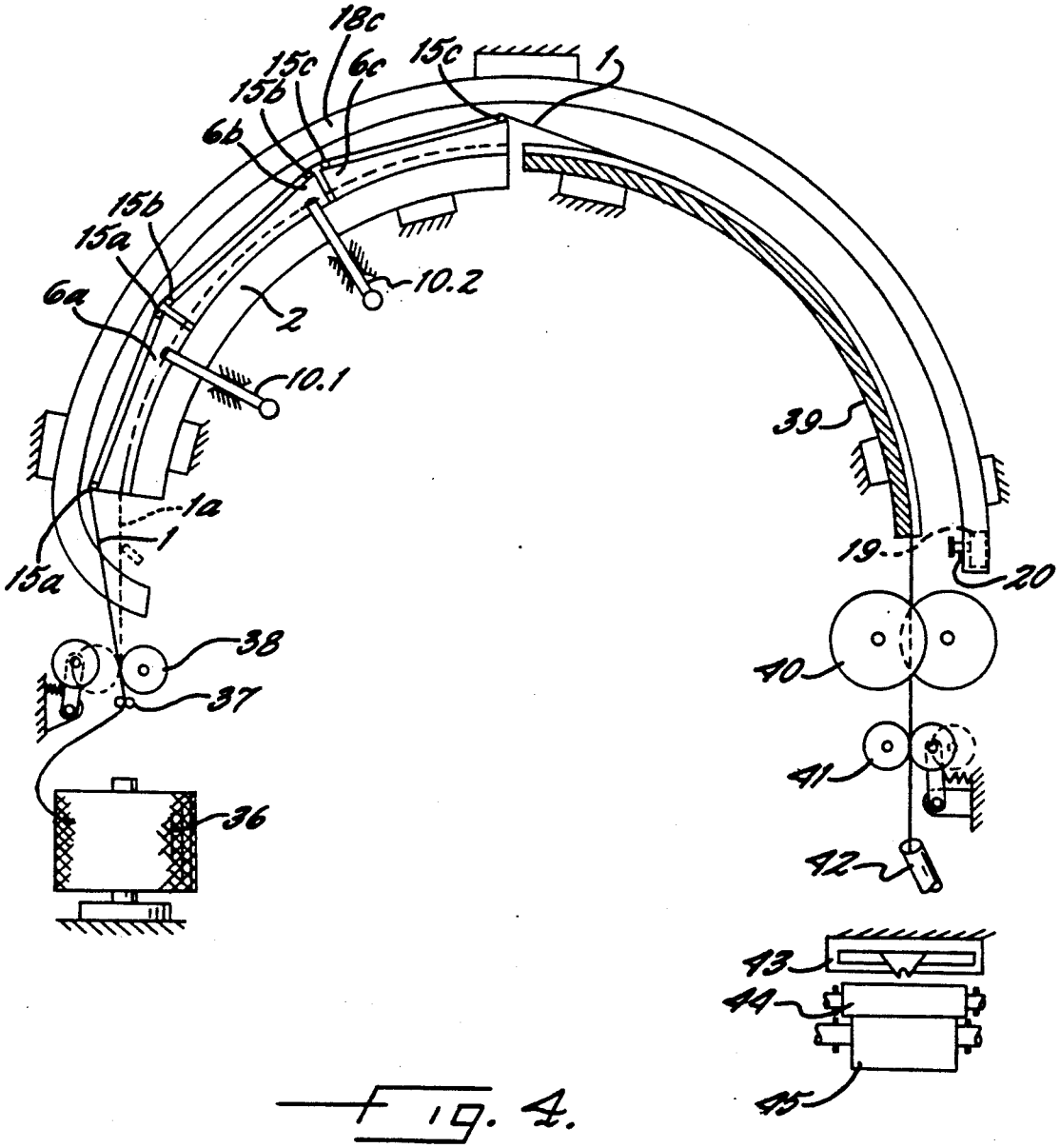
FIG. 4 is a schematic side elevation view of a yarn false twist crimping apparatus which embodies the present invention.

Referring now to FIG. 4, the method of threading a yarn on the processing station of a false twist crimping machine is described. To carry out the method, the heater 2 is provided with a cover divided into three parts. It is possible to open the cover segment **6*a* by means of the actuating rod 10.1 independently of the other two segments 6*b* and 6*c*. To service two segments 6*b* and 6*c* an actuating rod 10.2 is used. The segments 6*b* and 6*c*** are interconnected such that can be opened jointly. To this end, reference is made of DE-PS 38 13 133. The other parts are conventional.

When threading a yarn, all segments of the cover are initially closed. The yarn 1 is withdrawn from the supply package 36, threaded through the guide 37, and connected with the arm 20 by means of clamping device 33 (see, for example, FIG. 3) or in any other manner. In so doing, the piston 19, on which the arm 20 is mounted, is still at the left end of the tube in the region of the first feed system 38. Once the yarn is clamped or attached to the arm 20, the piston is moved to the right-hand position, which is shown in FIG. 4, thereby placing the yarn over the yarn guides **15*a*, 15*b*, 15*c*, which are attached on the outside of the cover sections 6*a*, 6*b*, 6*c*, and subsequently over the cooling plate 39. When the piston 10 arrives at the right end of the tube, the yarn is removed by means of a suction gun 42 and inserted into the false twist unit 40 and into the subsequent feed system 41. The feed system 41 is now engaged, and the false twist unit starts to operate. The false twist unit is here an apparatus as is disclosed in EP-B 22743 corresponding to U.S. Pat. No. 4,339,915. The feed system 38** upstream of the heating system is still open.

Now, the first segment **6*a* is opened by means of handle 10.1. As a result the yarn drops from the outside of the cover and comes into contact with a portion of the heating plate 2. In so doing, the yarn advances from the yarn guide 37, which is located at the inlet end of the heating plate, to the first yarn guide 15*b* on the cover section 6*b*. The length of contact is therefore, however, only very short. Consequently, the yarn which is withdrawn by the feed system 41 from the supply package 36 without engagement of the feed system 38, is slightly heated. However, the yarn has not yet undergone its final drawing, since the feed system 38 is still disengaged. As a result, the suction gun 42 continues to remove the yarn to waste. The first feed system 38 can now be engaged, thereby imparting to the yarn a desired drawing. The two other cover segments 6*b* and 6*c* are now also opened by shifting the actuating rod 10.2. As a result, the yarn drops over the entire length of the heating plate 2, as seen in dashed lines at 1*a*. All cover segments are then closed, and the yarn is threaded on the traversing system 43 and the empty tube 44, which has already been put into rotation by drive roll 45**.

In the drawings and specification, there has been set forth a preferred embodiment of the invention, and although specific terms are employed, they are used in a generic and descriptive sense only and not for purposes of limitation.

That which is claimed is:

1. A yarn heating apparatus for thermally processing an advancing yarn in a yarn false twisting machine, comprising;

an elongate yarn heating plate, cover means mounted for movement between a closed position covering said heating plate and an open position wherein said heating plate is uncovered, said cover means including an opposite side which faces away from said heating plate in said closed position, and yarn supporting means for supporting said yarn for advance along a temporary path of travel on said opposite side of said cover means when said cover means is in said closed position, and for releasing said yarn when said cover means moves to said open position so that said yarn is free to drop onto said heating plate to be advanced in contact with said heating plate.

2. The yarn heating apparatus as defined in claim 1 wherein said cover means is mounted for sliding movement between said open and closed positions in a direction which is lateral to the elongate yarn heating plate.

3. The yarn heating apparatus as defined in claim 2 wherein said heating plate includes a longitudinal yarn receiving groove, and wherein said yarn supporting means comprises a stationary yarn contacting member positioned to engage the yarn carried by said yarn supporting means when said cover means is moved to said open position so as to cause the yarn to be released from said yarn supporting means and drop into said groove of said heating plate.

4. The yarn heating apparatus as defined in claim 1 wherein said cover means is mounted for pivotal movement about at least one longitudinal axis.

5. The yarn heating apparatus as defined in claim 4 wherein said yarn supporting means comprises at least one member mounted to said cover means so as to extend laterally of and above said heating plate when said cover means is in said closed position, one end of said member being positioned directly above an associated yarn receiving groove in said heating plate when said cover means is in its said open position, whereby upon pivotal movement of said cover means the yarn carried by said member slides laterally therealong into the associated groove of said heating plate.

6. The yarn heating apparatus as defined in claim 1 wherein said cover means is divided into separate longitudinal segments separately moveable between said open and closed positions.

7. The yarn heating means as defined in claim 1 wherein said heating plate is arcuately curved along its length so as to define an upwardly facing convex yarn guide surface, and said cover means is positioned adjacent said upwardly facing convex yarn guide surface of said heating means.

8. The yarn heating apparatus as defined in claim 1 wherein said cover means comprises a pair of laterally adjacent covers separately moveable between said open and closed positions, each cover overlying about one lateral half of the heating plate in the closed position thereof.

9. A yarn heating apparatus adapted for thermally processing an advancing yarn in a yarn false twisting machine, comprising:

an elongate yarn heating plate having a longitudinal yarn receiving groove therein, at least one cover mounted for movement between a closed position overlying the heating plate and an open position wherein said plate is uncovered, and first guide means mounted to said one cover, and second guide means mounted to be independent of said one cover movement, and with said first and second guide means being configured such that in said closed position of said one cover said first and second guide means define a temporary yarn path, and said second guide means includes an end disposed above said yarn receiving groove, and so that movement of said one cover to said open position causes said first guide means to move relative to said second guide means and to thereby release the yarn from said temporary yarn path and such that the yarn is guided by said second guide means into said groove.

10. The yarn heating apparatus as defined in claim 9 wherein said cover is mounted for pivotal movement about a longitudinal axis extending substantially parallel to said groove.

11. A yarn heating apparatus for thermally processing an advancing yarn in a yarn false twisting machine, comprising:

an elongate yarn heating plate defining a longitudinal direction and a lateral direction, and having two longitudinal yarn receiving grooves formed therein which are laterally spaced from each other, first and second laterally adjacent cover means each mounted for movement between a position covering a respective lateral side portion of said heating plate and a position wherein the respective lateral side portion is uncovered, each of said cover means including an opposite side which faces away from said heating plate in said covering position thereof, and yarn supporting means including a yarn guide carried by each of said cover means for supporting a yarn for advance along a temporary path of travel on said opposite side of each cover means when the cover means associated therewith is in said covering position, and for releasing the yarn carried by said first cover means when said first cover means moves to its uncovered position so that the yarn is guided to drop into a first one of said grooves of said heating plate, and for releasing the yarn carried by said second cover means when said second cover means moves to its uncovered position so that the yarn is guided to drop into a second one of said grooves of said heating plate.

12. The yarn heating apparatus as defined in claim 11 wherein each of said cover means is mounted for sliding movement in the lateral direction between said uncovered and covering positions.

13. The yarn heating apparatus as defined in claim 12 wherein said yarn supporting means further comprises a first fixed yarn contacting member positioned to engage the yarn carried by said first cover means when said first cover means is moved to its uncovered position so as to cause the yarn to be released from the yarn guide associated with said first cover means and drop into said first groove of said heating plate, and a second fixed yarn contacting member positioned to engage the yarn carried by said second cover means when said second cover means is moved to its uncovered position so as to cause the yarn to be released from the yarn guide associated with said second cover means and drop into said second groove of said heating plate.

14. The yarn heating apparatus as defined in claim 11 wherein each of said cover means is mounted for pivotal movement about a separate longitudinal axis.

15. The yarn heating apparatus as defined in claim 14 wherein said yarn guide of each of said cover means is a laterally directed member which is open on the side thereof facing opposite its associated cover means and with one end thereof being directly above the associated groove of said heating plate in said uncovered position such that upon pivotal movement of each cover means the yarn carried thereby slides laterally along said member and drops into the associated groove of said heating plate.

16. A yarn heating apparatus adapted for thermally processing an advancing yarn in a yarn false twisting machine, comprising:

an elongate yarn heating plate defining a longitudinal direction and a lateral direction, and having two longitudinal yarn receiving grooves formed therein which are laterally spaced from each other, first and second laterally adjacent cover means each mounted for movement between a closed position covering a respective lateral side half of said heating plate and an uncovering position wherein said respective lateral side half is uncovered, and first guide edge means mounted on said first cover means, and second guide edge means mounted on said second cover means, said first and second guide edge means being configured such that in said closing position of said first and second cover means, said first and second guide edge means define a yarn receiving Vee when viewed in cross section, said first and second guide edge means being curved to define an end disposed above a first one and a second one of said grooves respectively, whereby movement of said second cover means to said uncovering position causes the yarn to be guided by said first guide edge means into said first groove, and movement of said first cover means to said uncovering position causes the yarn to be guided by said second guide edge means into said second groove.

17. The yarn heating apparatus as defined in claim 16 wherein each of said first and second cover means is mounted for pivotal movement about a longitudinal axis.

18. In a yarn false twist crimping apparatus for false twisting synthetic yarn, comprising a first yarn feeding means for withdrawing a yarn from a supply package and advancing said yarn along a path of travel, an elongate yarn heating plate positioned along said path of travel, an elongate yarn cooling plate positioned along said path of travel downstream of said heating plate, yarn false twisting means positioned along said path of travel downstream of said cooling plate, second yarn feeding means positioned along said path of travel downstream of said yarn false twisting means for withdrawing said yarn from said false twisting means, winding means for winding the yarn into a package, the improvement comprising:

cover means mounted for movement between a closed position covering said heating plate and an open position wherein said heating plate is uncovered, said cover means including an opposite side which faces away from said heating plate in said closed position, and yarn supporting means for supporting said yarn for advance along a temporary path of travel on said opposite side of said cover means when said cover means is in said closed position, and for releasing said yarn when said cover means moves to said open position to drop said yarn onto said heating plate to be advanced along an operative path of travel in contact with said heating plate.

19. The yarn false twist crimping apparatus as defined in claim 18, wherein said cover means is divided into separate longitudinal segments, each cover segment being separately moveable between said open and closed positions.

20. The yarn false twist crimping apparatus as defined in claim 18, wherein said heating plate is arcuately curved along its length so as to define an upwardly facing convex yarn guide surface, and said cover means is positioned adjacent said upwardly facing convex yarn guide surface of said heating means.

21. The yarn false twist crimping apparatus as defined in claim 18, wherein said cover means comprises a pair of laterally adjacent covers which are separately moveable between said open and closed positions, each cover overlying substantially one lateral side half of the heating plate when in the closed position thereof.

22. The yarn false twist crimping apparatus as defined in claim 18, further comprising means for threading a yarn along said temporary path of travel when said cover means is in said closed position.

23. The yarn false twist crimping apparatus as defined in claim 18, wherein both said yarn heating plate and said yarn cooling plate is arcuately curved along its length so as to form an upwardly vaulted structure.

24. The yarn false twist crimping apparatus as defined in claim 23 wherein said heating plate includes a yarn guideway which extends along the upwardly facing side of said upwardly vaulted structure.

25. The yarn false twist crimping apparatus as defined in claim 23 further comprising means for threading a yarn along said temporary path of travel when said cover means is in said closed position.

26. A method of threading a yarn heating apparatus for thermally processing an advancing yarn in a yarn false twisting machine which comprises an elongate yarn heating plate and cover means mounted for movement between a closed position covering said heating plate and an open position wherein said heating plate is uncovered, and with said cover means including an opposite side which faces away from said heating plate in said closed position, comprising the steps of:

closing said cover means, guiding the yarn along a temporary path of travel on said opposite side of said cover means when in its closed position, and opening said cover means to cause said yarn to move from said temporary path of travel onto said heating plate so as to permit the yarn to be advanced along an operative path of travel in contact with said heating plate.

27. The method as defined in claim 26, wherein said cover means is divided into separate longitudinal segments, and wherein said step of opening said cover means includes sequentially opening said segments so that the yarn is sequentially brought into contact with serial portions of said heating plate.

* * * * *